US010006238B2

(12) United States Patent
Hashimoto et al.

(10) Patent No.: US 10,006,238 B2
(45) Date of Patent: Jun. 26, 2018

(54) LOAD-TYPE DOOR OPENING AND CLOSING DEVICE

(71) Applicants: NISSHO-INDUSTRY CO., LTD., Fukuoka (JP); YUKI CORPORATION, Fukushima (JP)

(72) Inventors: Tamotsu Hashimoto, Fukushima (JP); Narinobu Fujishin, Fukuoka (JP)

(73) Assignees: NISSHO INDUSTRIAL CO., ITD, Kasuya-Gun (JP); YUKI CORPORATION, Aizuwakamatsu-Shi (JP)

( * ) Notice: Subject to any disclaimer, the term of this patent is extended or adjusted under 35 U.S.C. 154(b) by 0 days. days.

(21) Appl. No.: 15/303,921

(22) PCT Filed: Mar. 9, 2015

(86) PCT No.: PCT/JP2015/056822

§ 371 (c)(1),
(2) Date: Oct. 13, 2016

(87) PCT Pub. No.: WO2015/159609

PCT Pub. Date: Oct. 22, 2015

(65) Prior Publication Data

US 2017/0037670 A1 Feb. 9, 2017

(30) Foreign Application Priority Data

Apr. 18, 2014 (JP) ..... 2014-086640

(51) Int. Cl.
*E05B 65/00* (2006.01)
*E05F 13/04* (2006.01)
(Continued)

(52) U.S. Cl.
CPC ..... *E05F 13/04* (2013.01); *E05D 15/063* (2013.01); *E05F 1/16* (2013.01)

(58) Field of Classification Search
CPC ..... E05F 1/16; E05F 13/04; E05D 15/063
(Continued)

(56) References Cited

U.S. PATENT DOCUMENTS 1,593,845 A 7/1926 Owens
3,481,079 A * 12/1969 Claes ..... E06B 3/4636 49/216
(Continued)

FOREIGN PATENT DOCUMENTS

CN 202659019 U 1/2013
EP 2 211 007 A1 7/2010
(Continued)

OTHER PUBLICATIONS

Chinese Office Action dated Aug. 17, 2017 with English Translation, 9 pages.
(Continued)

*Primary Examiner* — Jerry E Redman
(74) *Attorney, Agent, or Firm* — Rankin, Hill & Clark LLP

(57) ABSTRACT

A sliding door opening and closing device that horizontally opens and closes the sliding door with application of light weight is provided. A load-type door opening and closing device includes: a sliding support rail slidably supporting the door to open and close the door; a door opening rail provided in the door and inclined upward in an opening direction of the door; a sliding member sliding on the door opening rail; a footboard; and a coupling member that couples the sliding member with the footboard. The sliding member is located at an upper end side of the door opening rail when the door is closed, and is depressed against the door opening rail by stepping force acting on the footboard during opening operation, to displace the door in the opening direction.

7 Claims, 8 Drawing Sheets

(51) Int. Cl.
*E05D 15/06* (2006.01)
*E05F 1/16* (2006.01)

(58) Field of Classification Search
USPC ..... 49/263, 264, 273, 274
See application file for complete search history.

(56) References Cited

U.S. PATENT DOCUMENTS

| | | | | |
|---|---|---|---|---|
| 7,861,461 | B2 * | 1/2011 | Nakano | E05F 1/02 49/226 |
| 2014/0311032 | A1 * | 10/2014 | Nakano | E05F 13/04 49/272 |

FOREIGN PATENT DOCUMENTS

| | | |
|---|---|---|
| EP | 2 711 494 A1 | 3/2014 |
| JP | 06-037482 | 5/1994 |
| JP | 07-208016 | 8/1995 |
| JP | 07-286476 | 10/1995 |
| JP | 11-324480 | 11/1999 |
| JP | 2000-220343 | 8/2000 |
| JP | 2000-274139 | 10/2000 |
| JP | 4253034 | 1/2009 |
| JP | 2010-019041 | 1/2010 |
| JP | 2010-037921 | 2/2010 |
| JP | 2012-251420 | 12/2012 |
| JP | 2015-209666 | 11/2015 |
| KR | 2012-0057761 | 6/2012 |

OTHER PUBLICATIONS

International Search Report, dated May 26, 2015 (May 26, 2015).
European Search Report dated Nov. 23, 2017, 8 pages.
Korean Office Action dated Apr. 16, 2018, 4 pages.

* cited by examiner

LOAD-TYPE DOOR OPENING AND CLOSING DEVICE

TECHNICAL FIELD

The present invention relates to a load-type door opening and closing device provided with an opening and closing mechanism that uses a body weight of a person to open and close a door.

Specifically, the present invention relates to an automatic door opening method that opens a sliding door at an entrance through application of a body weight of a user or a weight of a cart, and to an entrance automatic opening and closing door using the method. The invention belongs to a technical field of an entrance opening sliding door mechanism that does not include an power source such as an electric motor and a hydraulic motor and operates only by stepping force of a user or a cart, and relates in particular to an entrance automatic opening and closing door natural energy use propulsion device with no-power supply that moves the door in the opening direction with use of stepping force.

BACKGROUND ART

The load-type door opening and closing device of this type is conventionally represented by a device disclosed in the following Patent Literature 1. Such a load-type door opening and closing device comprises: a sliding support rail that is inclined downward in a closing direction of a door and supports the door; a door opening rail that is inclined downward in an opening direction of the door and is fixed to the door; a sliding member that is movably contacted with the door opening rail; and a door opening mechanism that converts stepping force applied to a footboard in a down direction into component force of the sliding member in an up direction through leverage.

Specifically, Patent Literature 1 proposes to provide a transferring mechanism to convert and transfer a settlement amount of a footboard provided on a floor surface in front and rear positions of the sliding door, as a predetermined displacement through a lever. A weight balance is set to maintain a floating state of the footboard through the lever by the settlement due to the own weight of an adjusting weight and the transferring mechanism. The horizontal opening of the sliding door is operated with light load by pressing a driving rotor against the door opening rail by a vertical operation of a long transmission member.

Other Peripheral Technologies are Described Below Supplementally.

There are a large number of patent applications for a mechanism that uses, as a power source, a load displacement by a body weight of a user or a cart to open and close a sliding door at an entrance, without using an additional power source such as an electric motor, or the like.

For example, a mechanism of a system (inclination system) that uses a displacement by stepping to allow a link mechanism to appropriately incline a guide rail provided at an upper part or a lower part of a sliding door in a desired moving direction, and accordingly slidingly move the sliding door along the inclination, has been disclosed in the following Patent Literature 2 and the like.

However, since such an inclination system relies only on natural movement of the sliding door on an inclined surface caused by own weight of the sliding door, quick movement with high responsiveness is difficult and it is troublesome for frequent passage.

Also, when dust is accumulated on the guide rail in use for many years, the inclination system is largely influenced disadvantageously. In addition, when any failure occurs on the operating force transferring mechanism having the above-described configuration, manual movement of the door cannot be performed or is extremely difficult, disadvantageously.

In particular, various kinds of inventions for an entrance automatic opening and closing mechanism that uses stepping force of a passerby as an operation source have been disclosed (refer to Patent Literature 3).

For example, a number of inventions for a method (fluid pressure use system) that replaces a displacement (mainly, a settlement amount) of a footboard by stepping force of a passerby into variation of fluid pressure such as hydraulic pressure, water pressure, or atmospheric pressure, thereby operating a cylinder and piston mechanism to open and close a sliding door have been disclosed (refer to Patent Literature 3).

Also, as a different mechanism, there is a system (inclination open and close system) in which a settlement amount by stepping is transferred to a guide rail holding a sliding door through a transfer unit such as a crank body and a pulley, and the rail is inclined in a moving direction to open and close the sliding door (refer to Patent Literature 4).

Other devices of the inclination open and close system using application of a body eight of a person have been disclosed in addition to Patent Literature 1.

An economical device without using electricity that naturally opens and closes a door only by passage applying body weight onto a footboard has been proposed. In this device, a spring is mounted on an upper section of a rack, a chain is installed under the rack, the footboard is fixed under the chain and a gear is engaged with the rack, a belt is provided over a pulley fastened to the gear and another pulley, a wheel is placed on a rail, and one piece of the belt is fixed onto a mounting section (refer to Patent Literature 5).

There has been proposed an automatic opening and closing sliding door device using a stepping pressure that includes: a sliding door that is openably supported and is applied with a movement urging force in a closing direction; a footboard that is disposed on a floor surface at front and rear positions of the closed position of the sliding door so as to generate a predetermined settlement amount by stepping pressure of a person; a first actuating mechanism that converts the vertical movement amount of the footboard into a predetermined rotation angle and causes a first arm to move around based on the rotation angle; a lever mechanism that is connected to a front end of the moving first arm and expands the movement amount of the front end and outputs the movement; and a traction wire that is connected so as to draw the output side of the lever mechanism and the sliding door in the opening direction of the sliding door (refer to Patent Literature 6).

There has been proposed an automatic door that includes: a sliding door that is configured to open and close an entrance; a footboard that is disposed on a floor surface at front and rear positions of the entrance and is settled by a predetermined amount by stepping pressure of a person; a swinging body that has an end cooperated with the footboard and the other end swinging at a predetermined angle according to settlement of the footboard; a link mechanism that expands and converts movement of the other end of the swinging body into substantially linear momentum and outputs the momentum; and an operation arm that has an end part rotatably journaled on door pocket side and the other end part cooperated with the sliding door. The automatic door causes the output of the link mechanism to acts on a middle of an operation arm, thereby swinging the operation arm to open and close the sliding door (refer to Patent Literature 7).

In an automatic door using no electrical energy and necessitating no maintenance of a motor or the like, a hanger and an opening and closing hanger are provided integrally with the door. A sash roller pivotally installed on the hanger is made to run on a hanger rail so that the door can be opened and closed. The hanger is provided with a weight biasing the door in a closing direction. The opening and closing hanger is coupled with a rod that is projected by hydraulic pressure in a cylinder provided at a skeleton-side base frame. The hydraulic pressure in the cylinder is generated by a downward motion of a footstool. A method has been proposed in which, according to the above configuration, the pressure oil of the cylinder pushes out the rod to cause the door to open through the opening and closing hanger, and the door is closed by the weight in a stage where the force of the pressure oil vanishes (refer to Patent Literature 8).

It has been proposed to provide a semiautomatic opening door apparatus which enables the operation of opening a sliding door to open and close an entrance of a building or an agricultural simplified greenhouse or various greenhouses and the like to be automatically performed by operating a foot pedal, etc. (refer to Patent Literature 9).

A sliding door opening and closing device capable of automatically opening and closing a sliding door with a simple structure has been proposed in which a guide rail having the same width as that of the sliding door is arranged on an upper part of an opening, sash hanger engaged with the guide rail is mounted on a door-tip side of an upper side of the sliding door while a door-tail side of the guide rail is rotatably journaled, means for operating the door-tip side of the guide rail vertically is provided, wherein a sash-hanger wheel stop position when the sliding door is fully opened is located nearer to the door-tip side than the journaled position at the door-tail side of the guide rail (refer to Patent Literature 10).

The above is supplementary description for the peripheral technologies.

CITATION LIST

Patent Literature

Patent Literature 1
Japanese Patent No. 4253034 (Japanese Patent Laid-Open No. 2009-275499)
Patent Literature 2
Japanese Utility Model Laid-Open No. H06-37482
Patent Literature 3
Japanese Patent Laid-Open No. H07-286476
Patent Literature 4
Japanese Utility Model Laid-Open No. H06-37482
Patent Literature 5
Japanese Patent Laid-Open No. H07-208016
Patent literature 6
Japanese Patent Laid-Open No. H11-324480
Patent Literature 7
Japanese Patent Laid-Open No. 2000-274139
Patent Literature 8
Japanese Patent Laid-Open No. 2000-220343
Patent Literature 9
Japanese Patent Laid-Open No, 2010-19041
Patent Literature 10
Japanese Patent Laid-Open No. 2010-37921

SUMMARY OF INVENTION

Technical Problem

Here, according to the representative load-type door opening and closing device of Patent Literature 1, converting the stepping force applied to the footboard in the down direction into the component force of the sliding member in the up direction through leverage causes the sliding member to be pressed against the door opening rail in the up direction, and the sliding member accordingly moves along the upward inclination direction of the door opening rail, thereby moving the door in the opening direction.

However, in such an conventional load-type door opening and closing device, when the sliding member is pressed against the door opening rail in the up direction, the weight of the door is applied to the sliding member, which disadvantageously causes excess load to the sliding member.

Further, to move the door in the opening direction, it is necessary to move the sliding member along the inclination direction of the door opening rail against the applied weight of the door. Thus, operation speed of the door is disadvantageously slow even with use of leverage.

In such circumstances, it is an object of the invention to provide a load-type door opening and closing device that makes it possible to reduce a load of a sliding member to improve durability, and to achieve quick operation of a door.

Also, with respect to the above-described peripheral technologies, an object is to provide the following load-type door opening and closing device.

In other words, there are provided an automatic door opening method and an automatic door opening and closing device that eliminate difference of operation speed caused by defective of rapid response of door opening and closing with respect to load applied to the footboard, durability with respect to impactive stepping force by a plurality of concurrent users, and variation of the load applied to the footboard, and allows for manual open and close of the door without effort, as with the normal manual sliding door, even if failure occurs on the footboard mechanism unit and the coupling member. Also, there are provided a load-type door opening method and a load-type door opening and closing device that do not require facility construction such as wiring, takes a short time for installation, is easy in maintenance checkup, and has high operability.

In particular, as for the impact force of concurrent use by a plurality of users, it is necessary to design the power transferring metal fitting and the mechanism of the door opening rail that changes the impact force into pull-down force from above, and to prevent jumping up of the door, derailment from the supporting rail, and breakage of non-slip metal fittings, caused by the impact force. In addition, since temporal resting state caused by jumping up of the door and the component force that acts in a direction against the weight of the door body are eliminated, it is necessary to secure rapid responsiveness and durability of members.

The mechanism does not directly converts the stepping force that is obtained by the body weight of the user or a cart, into the opening and closing force of the door. Therefore, there are provided an automatic door opening method and an automatic door opening and closing device each including a coupling metal fitting that may be further improved in efficiency if there are a coupling metal fitting and advanced technology that transfer the component force most efficiently. The invention of the present application is made focusing on the above-described disadvantages, and there is provided a novel and high-operable automatic sliding door opening and closing device using stepping force. The automatic sliding door opening and closing device relates to an entrance automatic opening and closing door with natural energy use propulsion device having no-power supply that moves the door in the opening direction with use of stepping force.

Solution to Problem

In a load-type door opening and closing device provided with an opening and closing mechanism that uses a body weight of a person to open and close a door, a load-type door opening and closing device of a first invention comprises: a sliding support rail slidably supporting the door to open and close the door; a door opening rail provided in the door and inclined upward in an opening direction of the door; and a footboard that is coupled with a sliding member through a coupling member and moves the door in the opening direction with use of stepping force, the sliding member being configured to slide on the door opening rail, in which the sliding member is located at an upper end side of the door opening rail in a state in which the door is closed, and stepping force applied to the footboard during opening operation depresses the sliding member against the door opening rail to displace the door in the opening direction.

According to the load-type door opening and closing device of the first aspect of the invention, the stepping force acting on the footboard acts in the down direction so as to cause the sliding member to depress the door opening rail through the coupling member. Thus, the weight of the door is not applied to the sliding member, which allows for improvement in durability of the sliding member.

In other words, since the force acts on the door opening rail only in a vertical downward direction, the weight of the door body does not act against the impact force by a plurality of concurrent users, and durability of the respective members is accordingly improved as compared with a case of receiving the impact force from below. In addition, the coupling parts of the respective mechanisms receiving the impact force are also improved in durability, which decreases failure frequency.

Further, to move the door in the opening direction, it is sufficient to move the sliding member from the upper end side of the door opening rail in the down direction along the downward inclination direction of the door opening rail (without moving the sliding member along the upward inclination direction of the door opening rail against the application of the door weight). This makes it possible to improve operation speed of the door.

As mentioned above, according to the load-type door opening and closing device of the first invention, it is possible to reduce the load of the sliding member to improve durability, and to achieve quick operation of the door.

In a load-type door opening and closing device of a second aspect of the invention in the first aspect of the invention, the coupling member is of a type selected from: a pantograph type that includes a first coupling body and a second coupling body, the first coupling body being coupled with the footboard and operating in a vertical direction, the second coupling body having an one end coupled with the sliding member and an other end in contact with a ground, and being rotatably fitted to the first coupling body between the one end and the other end; a gear type that includes a first arm, a second arm, and a gear part, the first arm having an end coupled with the footboard, the second arm having an end coupled with the sliding member, and the gear part journaling the first arm and the second arm independently and operating the first arm and the second arm in opposite directions from each other; a cam type that includes a first arm, a second arm, and a cam mechanism, the first arm having an end coupled with the footboard, the second arm having an end coupled with the sliding member, and the cam mechanism being provided between the first arm and the second arm that are journaled to a common rotational shaft and operating the first arm and the second arm in opposite directions from each other; and a direct depressing type in which a coupling rod that extends in a perpendicular direction from the footboard and has an end coupled with the footboard and the other end provided with the sliding member.

According to the load-type door opening and closing device of the second aspect of the invention, when the coupling member is configured of the first coupling body and the second coupling body of the pantograph type, the stepping force depresses the sliding member against the door opening rail, with the other end (the grounding point) of the second coupling body as a fulcrum.

Therefore, when the coupling member is of the pantograph type, it is possible to specifically realize the load-type door opening and closing device that makes it possible to reduce the load of the sliding member to improve durability and has quick operation property of the door.

When the coupling member is configured of the gear type, the gear part moves the first arm and the second arm in opposite directions from each other, which converts the stepping force acting on the end of the first arm into the component force of the other end of the second arm in the down direction. Thus, the component force so acts as to depress the sliding member against the door opening rail.

Therefore, when the coupling member is of the gear type, it is possible to specifically realize the load-type door opening and closing device that makes it possible to reduce the load of the sliding member to improve durability and has quick operation property of the door.

When the coupling member is configured of the cam type, the pair of cam mechanism operates the first arm and the second arm in the opposite directions from each other, which converts the stepping force acting on the end of the first arm into the component force of the other end of the second arm in the down direction. Thus, the component force so acts as to depress the sliding member against the door opening rail.

Therefore, when the coupling member is of the cam type, it is possible to specifically realize the load-type door opening and closing device that makes it possible to reduce the load of the sliding member to improve durability and has quick operation property of the door.

When the coupling member is of the direct depressing type, the footboard is directly coupled with the sliding member through the coupling rod, and the stepping force so acts as to depress the sliding member against the door opening rail.

Therefore, when the coupling member is of the direct depressing type, it is possible to specifically realize the load-type door opening and closing device that makes it possible to reduce the load of the sliding member to improve durability and has quick operation property of the door.

According to a load-type door opening and closing device of the third aspect of the invention in the first or second invention, or in the load-type door opening and closing device according to claim 1 or 2, the load-type door opening and closing device of the third aspect of the invention makes it possible to van the component force in the door opening rail direction of the acting force of the sliding member acting on the door opening rail by varying the upward inclination angle of the door opening rail. Increasing the upward inclination angle on an upper end side of the door opening rail allows to increase the component force of the door opening rail direction of the acting force of the sliding member acting on the door opening rail. This makes it possible to rapidly start the opening operation of the door.

Accordingly, it is possible to specifically realize the load-type door opening and closing device that makes it possible to reduce the load of the sliding member to improve durability and has quick operation property of the door.

In any of the first to third aspect of inventions, a load-type door opening and closing device of the fourth invention comprises a winding device that biases the door in a closing direction by winding force of a wire coupled with the door.

According to the load-type door opening and closing device of the fourth aspect of the invention, the sliding member so acts as to push up the door opening rail when the door is displaced in the closing direction. Thus, providing the winding device that biases the door in the closing direction makes it possible to support the operation of the door in the closing direction.

As a result, it is possible to specifically realize the load-type door opening and closing device that makes it possible to reduce the load of the sliding member to improve durability and has quick opening and closing operation property of the door.

BRIEF DESCRIPTION OF DRAWINGS

FIG. 5A and FIG. 5B are diagrams in which FIG. 5A is a detailed explanatory diagram illustrating another modification of the load-type door opening and closing device of FIG. 1, and FIG. 5B is a plan view of the load-type door opening and closing device of FIG. 5A.

DESCRIPTION OF EMBODIMENTS

First Embodiment

A load-type door opening and closing device as an embodiment of the present invention is described with reference to FIGS. 1 to 3.

Figure 1A:
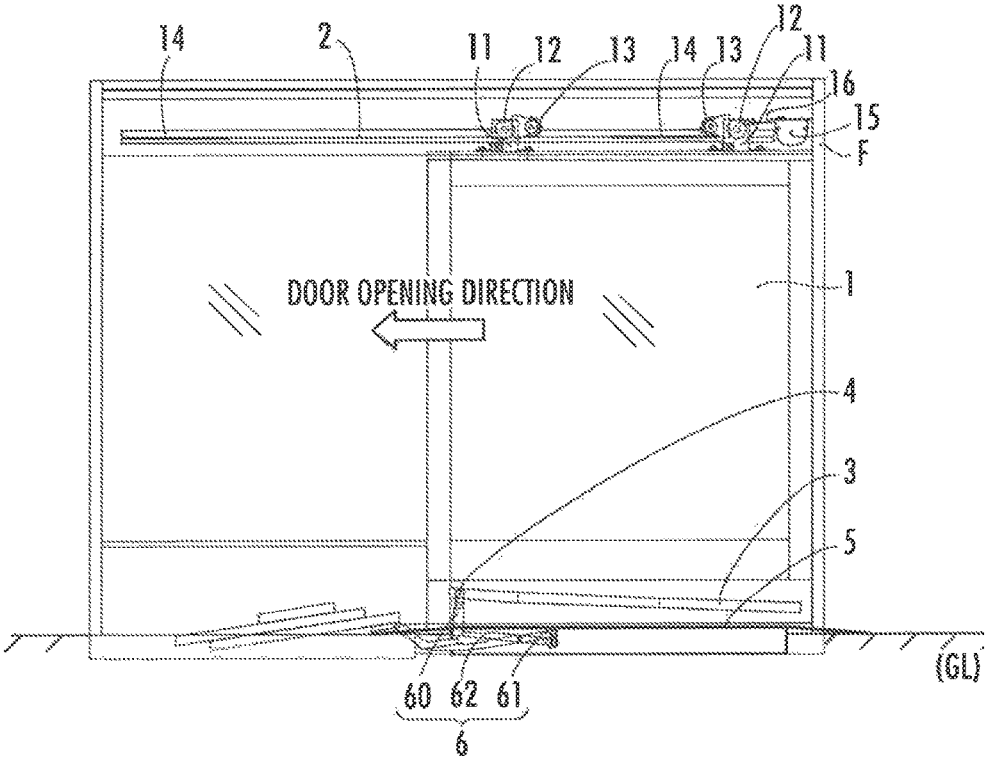
FIG. 1A and FIG. 1B are entire configuration diagrams of a load-type door opening and closing device according to an embodiment.
Figure 1B:
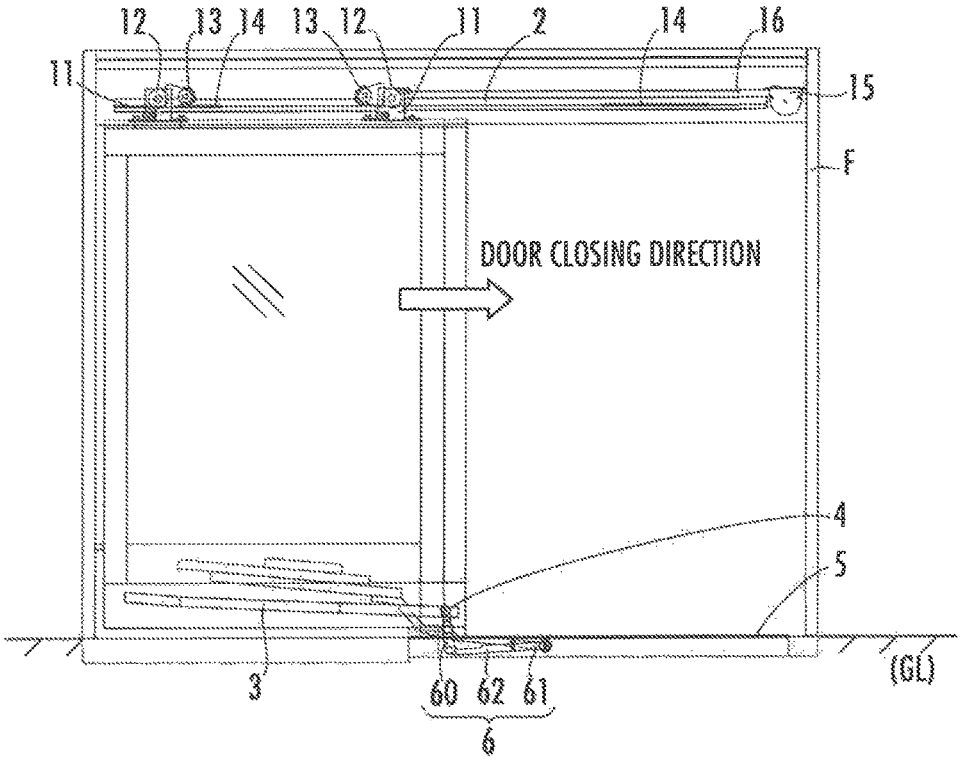

As illustrated in FIG. 1, the load-type door opening and closing device comprises an opening and closing mechanism that opens and closes a door 1. The load-type door opening and closing device comprises: a sliding support rail 2 that slidably supports the door 1 so as to open and close the door 1; a door opening rail 3 that is provided in the door 1; a sliding member 4 that is slidably attached to the door opening rail 3; a footboard 5; and a coupling member 6 that couples the sliding member 4 with the footboard 5.

Note that FIG. 1(*a*) illustrates a state before operation a state in which the door 1 is closed) and FIG. 1(*b*) illustrates a state after operation (a state in which the door 1 is open).

The door 1 is one sliding door (a single sliding door), and suspension hooks 11 and 11 are extended at both ends of an upper side of the door 1. Rollers 12 and 12 that are rotatably supported by the sliding support rail 2 are rotatably fitted respectively to the suspension hooks 11 and 11.

The sliding support rail 2 is a rail supported by a sash frame F or a building (not illustrated) in a horizontal direction, and the door 1 is slidably supported by the sliding support rail through the rollers 12 and 12.

Note that the suspension hooks 11 and 11 are respectively provided with auxiliary rollers 13 and 13 in addition to the rollers 12 and 12, and the auxiliary rollers 13 and 13 function to stabilize operation speed in auxiliary rails 14 and 14 that are provided at both ends of the sliding support rail 2.

Also, in the present embodiment, the sliding support rail 2 is installed horizontally, and the suspension hook 11 is biased (biased while winding force of a wire 16 is set to 2 to 10 N with respect to 20 kg to 100 kg of the weight of the door 1) in a closing direction of the door 1 with use of a constant force spring 15 (corresponding to a winding device of the present invention) through the wire 16. In addition thereto or in place thereof, the sliding support rail 2 may be slightly inclined upward in the opening direction (slightly inclined downward in the closing direction) of the door 1. In any case, the sliding support rail 2 assists the closing operation of the door 1 to smooth the closing operation.

The door opening rail 3 is a rail inclined upward in the opening direction at a lower part of the door 1, and is configured to be slidable while being in a state fitted with the sliding member 4.

An upward inclination angle of the door opening rail 3 varies, in a stepwise manner, such that the inclination angle becomes larger at an upper end side of the door opening rail and becomes smaller at lower end side of the door opening rail. Note that, in the present embodiment, the upward inclination angle is set in three stages, namely, the gradient is set to 15 to 16 degrees in an initial stage, 6 to 4 degrees in next stage, and 4 to 2 degrees in a final stage. Thus, the width in the initial stage is set within ⅓ of the length of the rail. However, it is not limited as such, and alternatively, the upward inclination angle may be set in two or four or more stages, or may be continuously varied as long as the upward inclination angle is large at the upper end side corresponding to the initial stage and is small at the lower end side corresponding to the final stage.

Note that the door opening rail 3 is incorporated in the lower part of the door 1, and an outer side thereof is covered by a cover (a decorative cover covering the lower end side of the door), which makes the door opening rail 3 invisible from a user in a normal usage state.

The sliding member 4 is a roller sliding while being fitted with the door opening rail 3, and is rotatably fitted to an end of the coupling member 6. Note that relationship between the sliding member 4 and the coupling member 6 is described in detail later.

Figure 2:
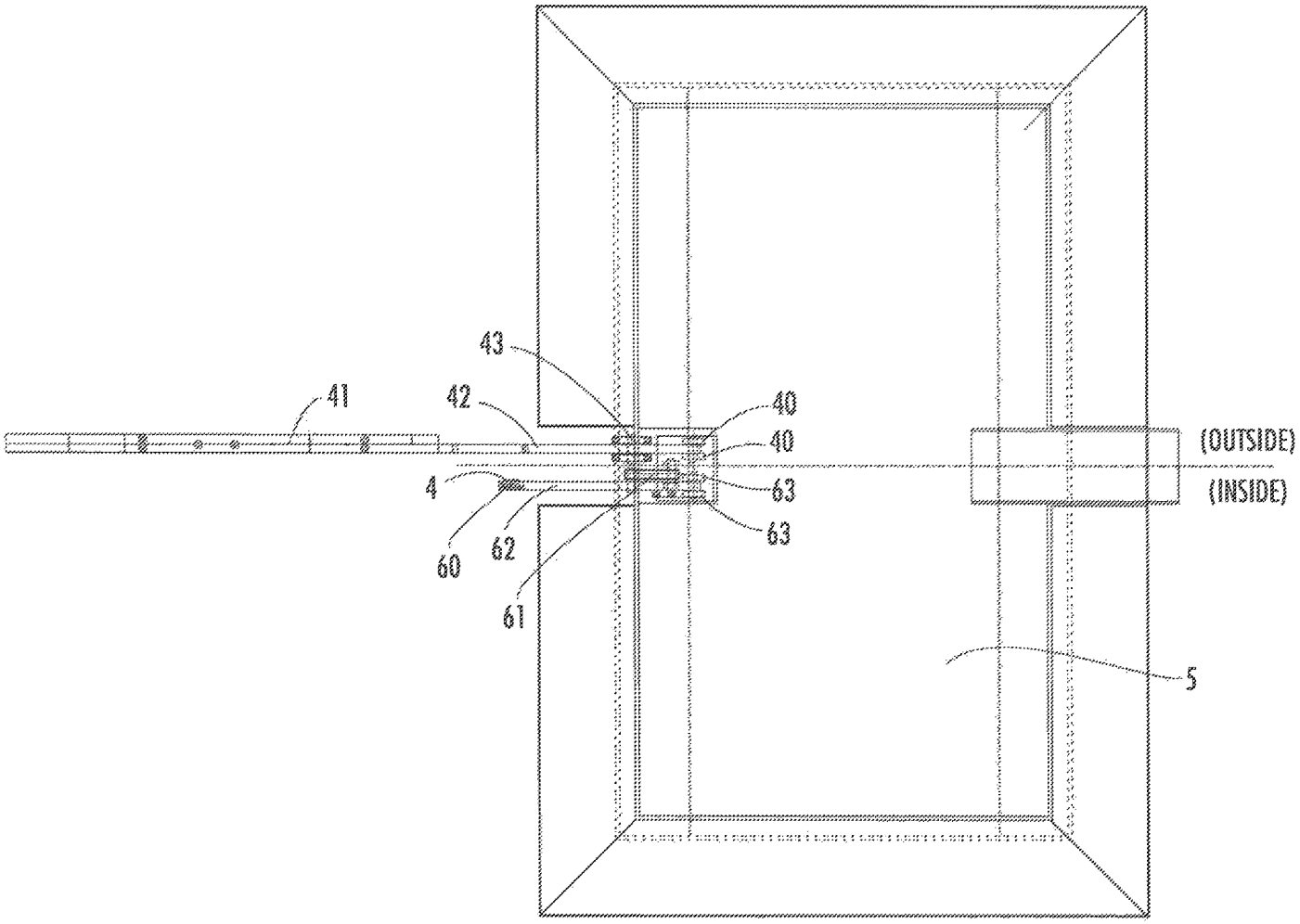
FIG. 2 is a plan view of the load-type door opening and closing device of FIG. 1.

As illustrated in a plan view of FIG. 2 (the door 1 and the sliding support rail 2 are omitted from illustration), the footboard 5 is a flat plate over the inside and the outside separated by the door 1, and is settled according to a stepping amount of a person.

Note that the footboard 5 is floated by a returning sliding member 40 that is in contact with a lower surface of the footboard 5 (a lower surface outside the footboard 5 in the figure) in a state in which no person steps on the footboard 5. More specifically, an arm 42 is rotatably fitted to the ground by a shaft part 43. The arm 42 has an end rotatably fitted with the returning sliding member 40, and the other end provided with a weight 41. Accordingly, in a state in which no person steps on the footboard 5, the returning sliding member 40 pushes up the lower surface of the footboard 5 by the weight 41 through the principle of the leverage with the shaft part 43 as a fulcrum. This causes the arm 42 to perform closing operation opposite to the opening operation of the sliding member 4. Note that, in addition thereto or in place thereof, a biasing unit or the like that biases the footboard 5 in an up direction may be provided.

The coupling member 6 is rotatably fitted to the lower surface of the footboard 5, and is configured of a first coupling body 61 and a second coupling body 62. The first coupling body 61 operates in a vertical direction in association with vertical operation of the footboard 5. The second coupling body 62 has an end that journals the sliding member 4, and the other end that is in contact with ground GL under the footboard 5.

Note that the first coupling body 61 may be extended from the lower surface of the footboard in the horizontal direction and operate in the vertical direction integrally with the footboard 5.

As illustrated in FIG. 2, the first coupling body 61 has an end that is coupled with (in the present embodiment, rotatably fitted to) the footboard 5, and the other end that journals the second coupling body 62.

Figure 3:
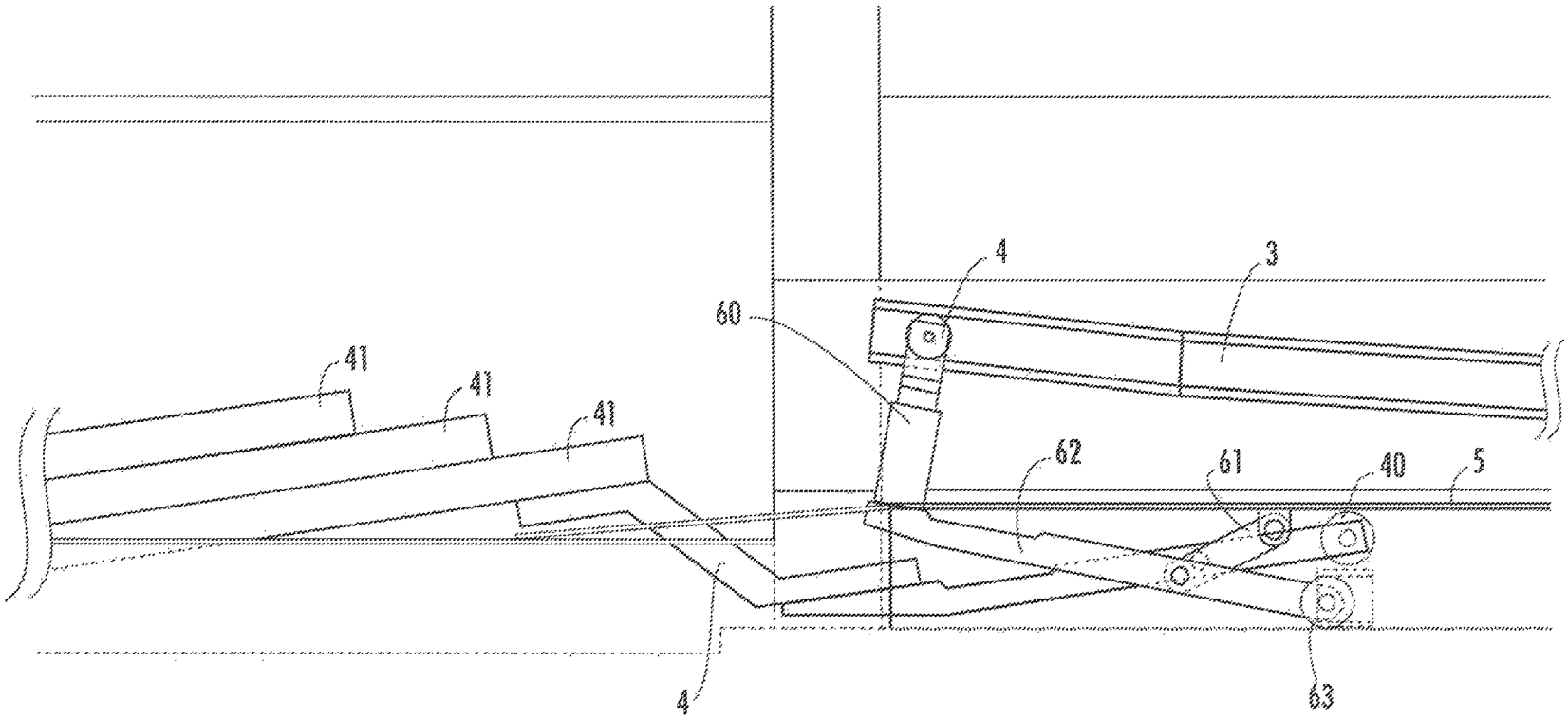
FIG. 3 is a detailed explanatory diagram of the load-type door opening and closing device of FIG. 1.

As illustrated in FIG. 3, the second coupling body 62 is rotatably fitted, at a center part (a position of a predetermined ratio between the one end and the other end that regulates the vertical movement), to the first coupling body 61, and the other end (a grounding point with the ground GL) of the second coupling body 62 is rotatably fitted to a grounding roller 63, and operates with the grounding roller 63 as a fulcrum.

The sliding member 4 is connected with the second coupling body 62 through a coupling rod 60. The coupling rod 60 is adjustable in length based on the connection position with the second coupling body 62, which allows positioning of the sliding member 4 to be fitted to the door opening rail 3.

According to the load-type door opening and closing device having the above-described configuration, when no person steps on the footboard 5, the footboard 5 is floated, and the sliding member 4 is accordingly fined with the door opening rail 3 at the highest position (at an upper end position of the door opening rail 3) in the perpendicular direction.

When a person steps on the footboard 5 in this state, stepping force generated on the footboard 5 becomes component force in a down direction of the second coupling body 62 through the first coupling body 61 that is integrated with the footboard 5. This pushes down the coupling rod 60 side of the second coupling body 62 with the grounding roller 63 as a fulcrum, and the sliding member 4 that is journaled to the coupling rod 60 so acts as to press down the lower surface of the door opening rail 3.

This displaces the door 1 in the opening direction along the inclination direction of the door opening rail 3 so as to release the component force applied through the sliding member 4. At this time, the weight of the door 1 is not applied to the sliding member 4, which makes it possible to reduce the load of the sliding member 4 to improve durability thereof.

Further, to move the door 1 in the opening direction, it is sufficient to move the sliding member 4 from the upper end side of the door opening rail 3 in the down direction along the downward inclination direction of the door opening rail 3. This makes it possible to improve operation speed of the door.

Further, since the upward inclination angle on the upper end side of the door opening rail 3 is large, it is possible to increase the component force in the door opening rail direction of downward acting force of the sliding member 4 that acts on the door opening rail 3. This makes it possible to rapidly start the opening operation of the door 1.

As mentioned above, according to the load-type door opening and closing device of the present embodiment, it is possible to reduce the load of the sliding member 4 to improve durability, and also to achieve quick operation of the door 1.

Second Embodiment

Figure 4A:
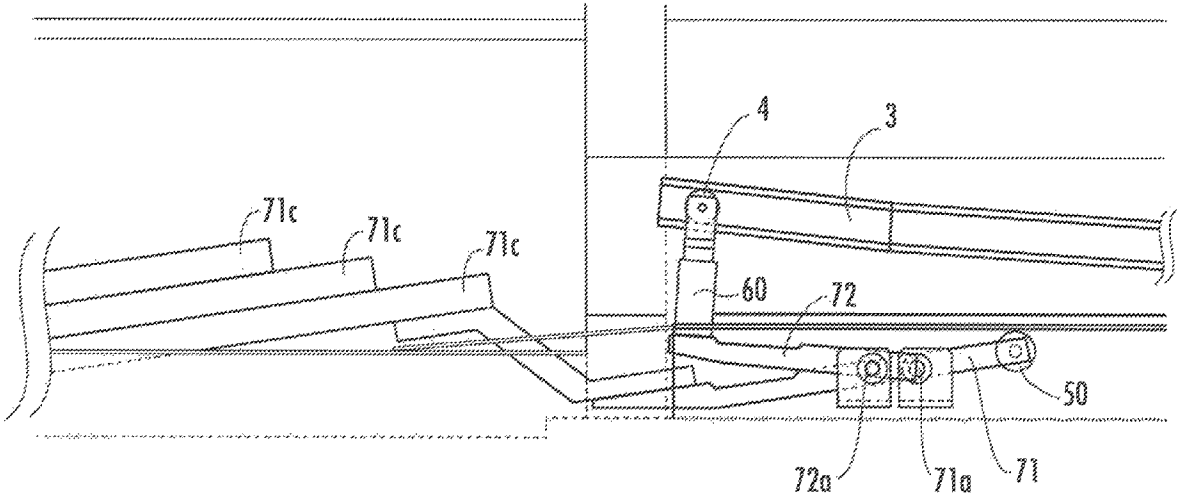
FIG. 4A and FIG. 4B are detailed explanatory diagrams of a modification of the load-type door opening and closing device of FIG. 1.
Figure 4B:
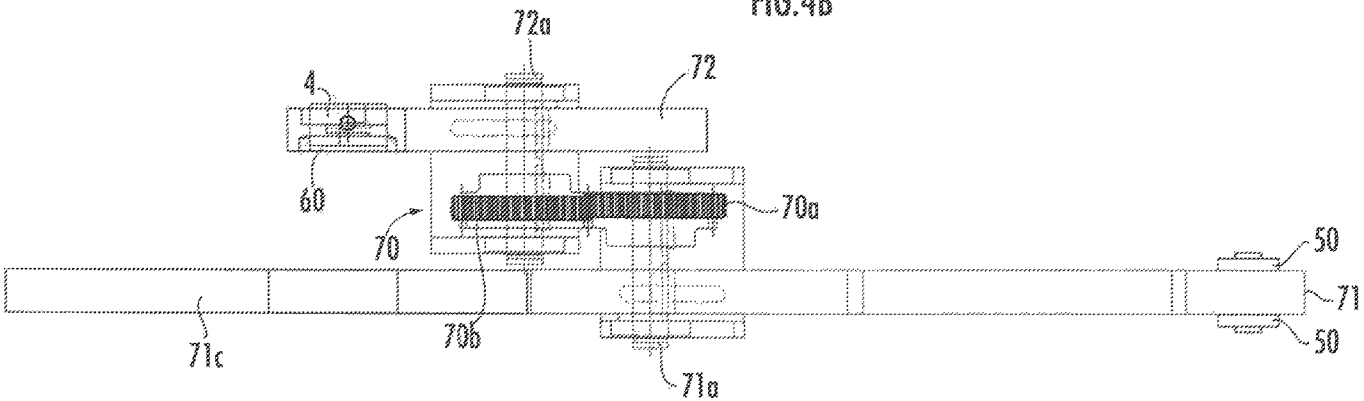

Next, as another load-type door opening and closing device of the present embodiment, a configuration that uses a gear section 70 serving as the coupling member 6 is described with reference to FIG. 4. Note that the components same as those of the above-described embodiment are denoted by the same reference numerals, and description thereof is omitted.

In this case, the coupling member 6 is configured of a first arm 71, a second arm 72, and the gear section 70. The first arm 71 has an end coupled with the footboard 5. The second arm 72 has the other end coupled with the sliding member 4. The gear section 70 is disposed between the first arm 71 and the second arm 72, and operates these arms in opposite directions from each other.

The gear section 70 includes a first gear 70*a* and a second gear 70*b*. The first gear 70*a* rotates integrally with the first arm 71 by a first coupling shaft 71*a*. The second gear 70*b* rotates integrally with the second arm 72 by a second coupling shaft 72*a*.

The first gear 70*a* and the second gear 70*b* are so engaged with each other as to respectively rotate the first arm 71 and the second arm 72 in opposite directions from each other, and a diameter ratio of the first gear 70*a* and the second gear 70*b* is a value exceeding 1 time in order to double the operation of the first arm 71 (for example, 2 to 3 times).

Note that the gear section 70 is incorporated in a space under the footboard 5, and is fixed to an unillustrated base.

The first arm 71 is brought into contact with and coupled with the footboard 5 through a footboard-side roller 50 that is rotatably fitted to the end of the first arm 71. In addition, the extending other end of the first arm 71 is provided with a weight 71*c*. Also, the first arm 71 is rotatably fitted at a center part to the first coupling shaft 71*a*.

The second arm 72 has an end that is rotatably fitted to the second coupling shaft 72*a*, and the other end that is coupled with the sliding member 4. Note that a mechanism with which the sliding member 4 is coupled is configured of the coupling rod 60 as with the above-described embodiment.

According to the load-type door opening and closing device having the above-described configuration, when a person steps on the footboard 5 from a state where no person steps on the footboard 5, stepping force generated on the footboard 5 acts on the end of the first arm 71 through the footboard-side roller 50, thereby moving the first arm 71 around the first coupling shaft 71*a* in a clockwise direction in the figure.

This causes the second gear 70*b* to rotate in the opposite direction through the first gear 70*a* on the common first coupling shaft 71*a*, and accordingly the second arm 72 on the second coupling shaft 72*a* moves in a counterclockwise direction in the figure.

When the second arm moves around in the counterclockwise direction, the coupling rod 60 side of the second arm 72 is depressed, and the sliding member 4 journaled to the coupling rod 60 so acts as to depress the lower surface of the door opening rail 3.

As with the above-described embodiment, the door 1 is displaced in the opening direction along the inclination direction of the door opening rail 3 so as to release the component force applied through the sliding member 4. At this time, the weight of the door 1 is not applied to the sliding member 4, which makes it possible to reduce the load of the sliding member 4 to improve durability thereof.

Further, to move the door 1 in the opening direction, it is sufficient to move the sliding member 4 from the upper end side of the door opening rail 3 in the down direction along the downward inclination direction of the door opening rail 3. This makes it possible to improve operation speed of the door.

As mentioned above, according to the load-type door opening and closing device of the present embodiment, it is possible to reduce the load of the sliding member 4 to improve durability, and to achieve quick operation of the door 1.

Note that, in the present embodiment, when no person steps on the footboard 5, the first arm 71 moves around in the counterclockwise direction in the figure by the weight 71*c* of the first arm 71, and the footboard 5 returns to the floating state through the footboard-side roller 50.

Third Embodiment

Figure 5A:
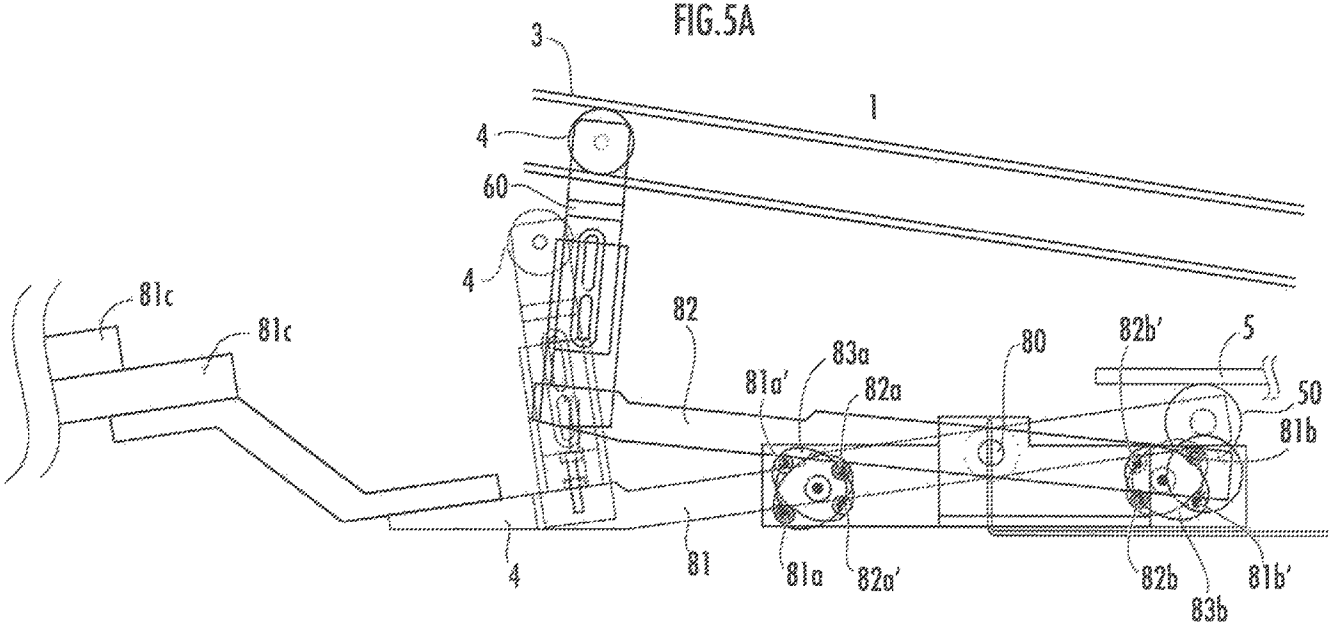
Figure 5B:
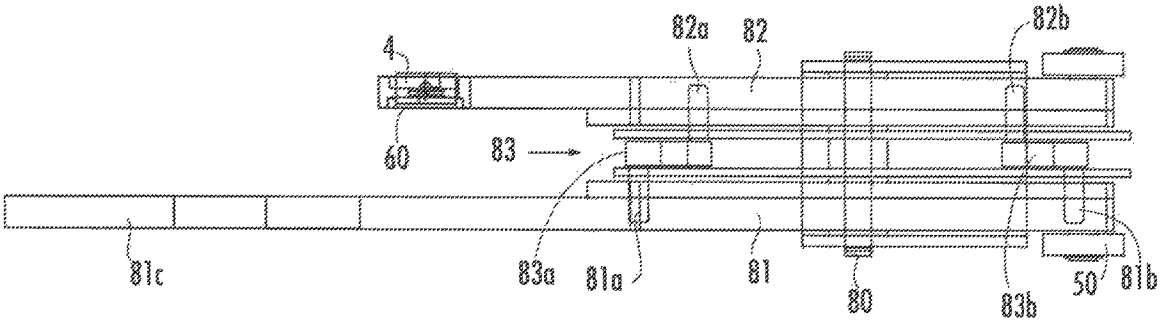

Next, another load-type door opening and closing device according to the present embodiment is described with reference to FIG. 5. Note that the components same as those of any of the above-described embodiments are denoted by the same reference numerals, and description thereof is omitted.

In this case, the coupling member 6 is configured of a first arm 81, a second arm 82, and a cam mechanism 83. The first arm 81 has an end coupled with the footboard 5. The second arm 82 has the other end coupled with a sliding member 4' (the sliding member is distinguished from the above-described sliding member 4 because one sliding member is half-supported in the present embodiment; the same shall apply hereinafter). The cam mechanism 83 is provided between the first arm 81 and the second arm 82, and respectively rotates the first arm 81 and the second arm 82 in opposite directions from each other.

The first arm 81 and the second arm 82 are rotatably journaled to a shaft body 80 at respective predetermined positions.

The first arm 81 is brought into contact with and coupled with the footboard 5 through the footboard-side roller 50 that is rotatably fitted to the end of the first arm 81. In addition, the extending other end of the first arm 81 is provided with a weight 81*c*.

The second arm 82 is coupled with and supports the sliding member 4 at the other end through the coupling rod 60, as with the above-described embodiments.

The pcam mechanism 83 includes an elliptical first cam 83*a* and an elliptical second cam 83*b* that are disposed on both sides of the shaft body 80. Arms 81*a* and 82*a* project from the cam 83*a* respectively toward the first arm 81 and the second arm 82, and arms 81*b* and 82*b* project from the cam 83*b* respectively toward the first arm 81 and the second arm 82. Note that the first cam 83*a* and the second cam 83*b* are attached to a shaft body that is supported by a frame provided on an unillustrated base, and are movable around the shaft body.

More specifically, the first cam 83*a* includes the arm 81*a* and the arm 82*a*. The arm 81*a* projects from the first cam 83*a* as to be in contact with a lower side surface of the first arm 81. The arm 82*a* projects from the first cam 83*a* as to be in contact with a lower side surface of the second arm 82.

The second cam 83*b* includes the arm 81*b* and the arm 82*b*. The arm 81*b* projects from the second cam 83*b* as to be in contact with the lower side surface of the first arm 81. The arm 82*b* projects from the second cam 83*b* as to be in contact with the lower side surface of the second arm 82.

According to the load-type door opening and closing device having the above-described configuration, when a person steps on the footboard 5 from a state where no person steps on the footboard 5, stepping force generated on the footboard 5 acts on one end of the first arm 81 through the footboard-side roller 50, thereby moving the first arm 81 around the shaft body 80 in the clockwise direction.

At this time, the arm 81*b* of the second cam 83*b* is depressed and also the arm 82*b* is raised. This causes the second arm 82 to move around in the counterclockwise direction.

Note that the positions of the anus 81*a*, 82*a*, 81*b*, and 82*b* after the moving operation are respectively denoted by arms 81*a*', 82*a*', 81*b*', and 82*b*'.

When the second arm 82 moves around in the counterclockwise direction, the coupling rod 60 side of the second arm 82 is depressed, and the sliding member 4' journaled to the coupling rod 60 acts as to depress the lower surface of the door opening rail 3.

As with the above-described embodiments, the door 1 is displaced in the opening direction along the inclination direction of the door opening rail 3 so as to release the component force applied through the sliding member 4'. At this time, the weight of the door 1 is not applied to the sliding member 4', which makes it possible to reduce the load of the sliding member 4' to improve durability thereof.

Further, to move the door 1 in the opening direction, it is sufficient to move the sliding member 4' from the upper end side of the door opening rail 3 in the down direction along the downward inclination direction of the door opening rail 3. This makes it possible to improve operation speed of the door.

As mentioned above, according to the load-type door opening and closing device of the present embodiment, it is possible to reduce the load of the sliding member 4' to improve durability, and also to achieve quick operation of the door 1.

Note that, in the present embodiment, when no person steps on the footboard 5, the first arm 81 moves around in the counterclockwise direction by the weight 81*c* of the first arm 81. At this time, the arm 81*a* of the first cam 83*a* is depressed and also the arm 82*a* is raised. This causes the second arm 82 to move around in the clockwise direction. Thus, the first arm 81 moves around in the counterclockwise direction to return the footboard 5 to the flowing state, and also the second arm 82 returns to the initial position (the upper end of the door opening rail 3) of the sliding member 4.

Fourth Embodiment

Next, another load-type door opening and closing device according to the present embodiment is described with reference to FIG. 6. Note that the components same as those of any of the above-described embodiments are denoted by the same reference numerals, and description thereof is omitted. In addition, description of the configurations of the returning sliding member 40 to return the footboard 5, the weight 41, the arm 42, and the shaft part 43 (respectively having the same configuration as components 40 to 43 in the first embodiment) that are configured is also omitted.

Figure 6:
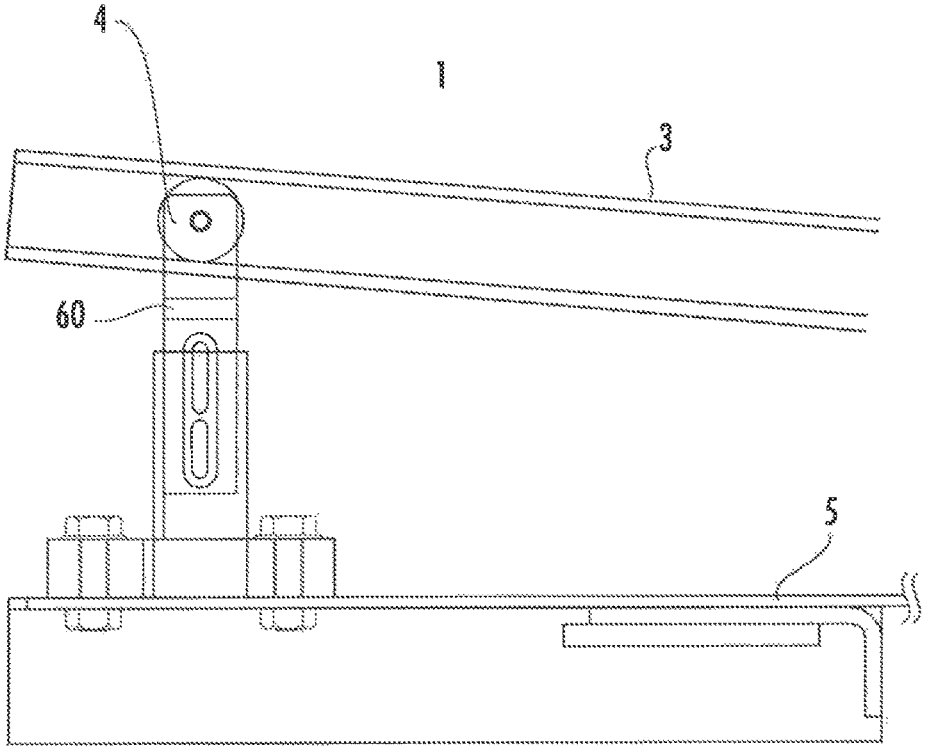
FIG. 6 is a detailed explanatory diagram illustrating still another modification of the load-type door opening and closing device of FIG. 1.

In the opening and closing device of FIG. 6, the coupling rod 60 is directly coupled with the footboard 5. In other words, the coupling member 6 is configured only of the coupling rod 60. The coupling rod 60 is extended in the perpendicular direction from the footboard 5, and has an end coupled with the footboard and the other end provided with the sliding member 4'.

Accordingly, the stepping force of the footboard 5 is directly transferred to the sliding member T through the coupling rod 60 that is integrated with the footboard 5, and the sliding member T accordingly acts as to depress the lower surface of the door opening rail 3.

As with the above-described embodiments, the door 1 is displaced in the opening direction along the inclination direction of the door opening rail 3 so as to release the component force applied through the sliding member 4'. At this time, the weight of the door 1 is not applied to the sliding member 4', which makes it possible to reduce the load of the sliding member 4 to improve durability thereof.

Further, to move the door 1 in the opening direction, it is sufficient to move the sliding member 4 from the upper end side of the door opening rail 3 in the down direction along the downward inclination direction of the door opening rail 3. This makes it possible to improve operation speed of the door.

As mentioned above, according to the load-type door opening and closing device of the present embodiment, it is possible to reduce the load of the sliding member 4' to improve durability, and to achieve quick operation of the door 1.

In the following, installation examples of the load-type door opening and closing device according to any of the present embodiments are described as Examples for reference.

Example 1

Figure 7:
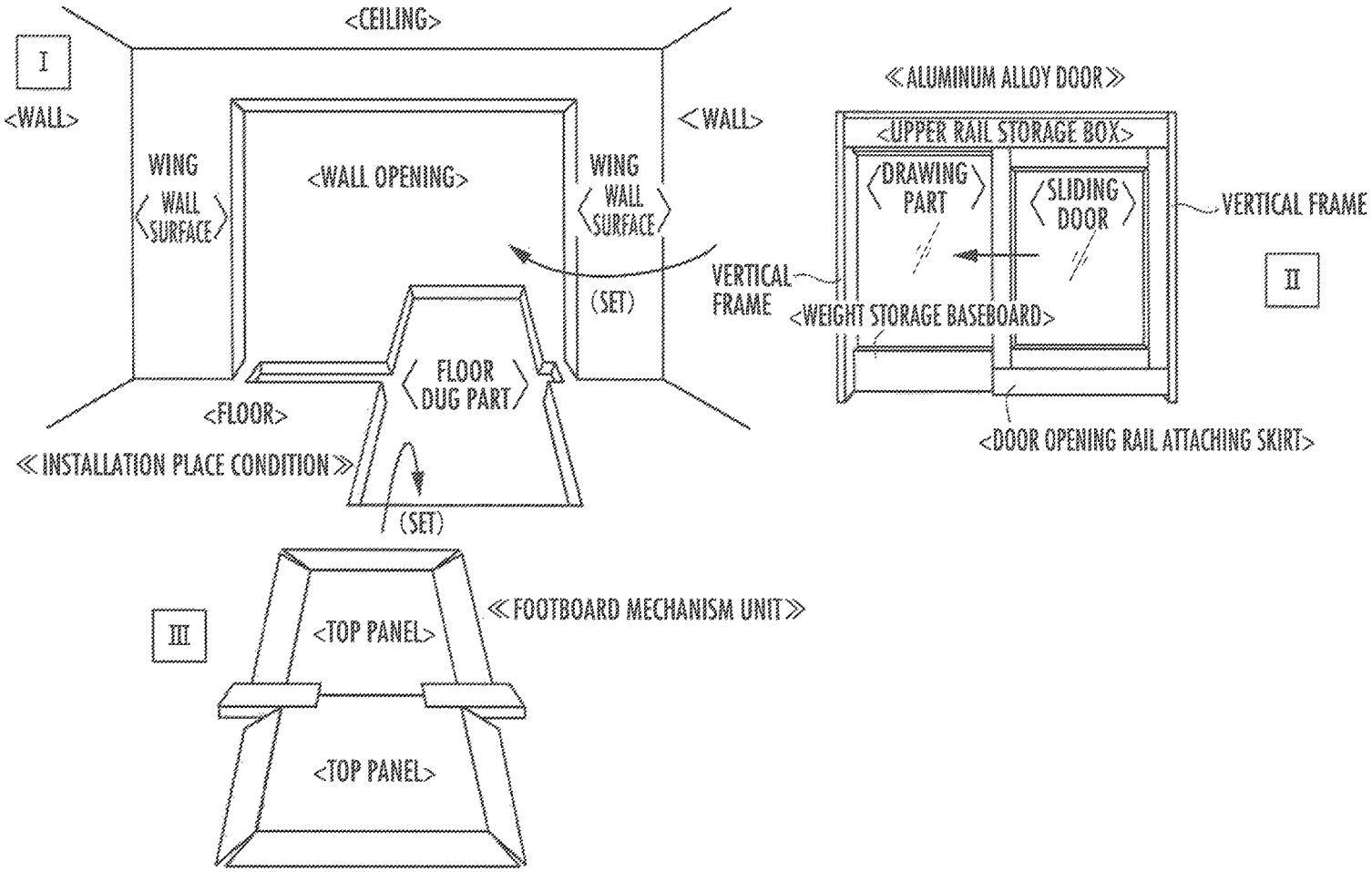
FIG. 7 is an explanatory diagram of Example 1 that illustrates an installation example of the load-type door opening and closing device of the present embodiment.

An aluminum alloy door illustrated in II of FIG. 7 was fabricated with use of A6063S-T5 aluminum alloy extraction mold prescribed in JIS H 4100. The aluminum alloy door was a single sliding door that had an effective opening of 800 mm width and 2000 mm height and an outer frame size of 1600 mm width and 2200 mm height. Also, a footboard mechanism unit having a top panel, illustrated in III of FIG. 7 was fabricated. The top panel was freely movable in the vertical direction, and a bottom surface of the top panel had 556 mm width, 956 mm length, and 70 mm height. These were disposed at predetermined positions of a wall opening and a floor dug part of the building, illustrated in I of FIG. 7.

At this time, a level was accurately adjusted in each of the perpendicular direction and the horizontal direction with use of a laser, followed by fixing. A coupling metal fitting that transferred stepping force of the above-described footboard mechanism unit was installed and fixed at a connection part of the footboard mechanism unit and a meeting mullion of the above-described aluminum alloy door with accuracy at which errors of a distance from the meeting mullion and the height from the bottom surface of the footboard mechanism unit were ±0.5 mm. A returning hardware was installed and fixed side by side with the coupling metal fitting. The returning hardware was configured to return atop plate of the footboard to an original position with use of a weight by the principle of leverage.

After it was confirmed that the top plate of the footboard was vertically moved by 20 mm to 30 mm, the aluminum alloy door was suspended to the supporting rail, and then fixed to a front end of the coupling fitting while the height of a depression runner roller serving as a sliding member was adjusted with respect to the door opening rail. The door opening rail was attached to a lower end skirt part of the door and had gradient of 1 to 3 stages. Then, transferring condition of the stepping force, a size of an opening of the door, and the opening and closing speed of the door were adjusted, and the exerted desired property was confirmed. The installation was thus completed. The door and the footboard mechanism unit operated with favorable response without jumping of the door caused by the impact force by a plurality of concurrent users, and no failure was observed.

Example 2

A development diagram of a frame and a door of a single sliding steel lightweight door was created. The door was to be formed with use of HS G 3302 hot dip galvanized steel sheet that had a thickness of 0.8 min, 1.6 mm, and 2.3 mm, and had a rectangular inner size of 0.95 m×0.2 m in an assembled state. Further, the lightweight door was manufactured through cutting process, pressing process, bending process, door assembling process, frame assembling process, painting of rust inhibitor and finish coating, temporal assembling inspection, appearance and dimension inspection. In addition, a footboard mechanism unit including a top plate that had a bottom surface of 556 mm width, 956 mm length, and 70 mm height and was freely movable in the vertical direction was manufactured. The products were packaged and shipped together with fittings and a shipping item list.

Figure 8:
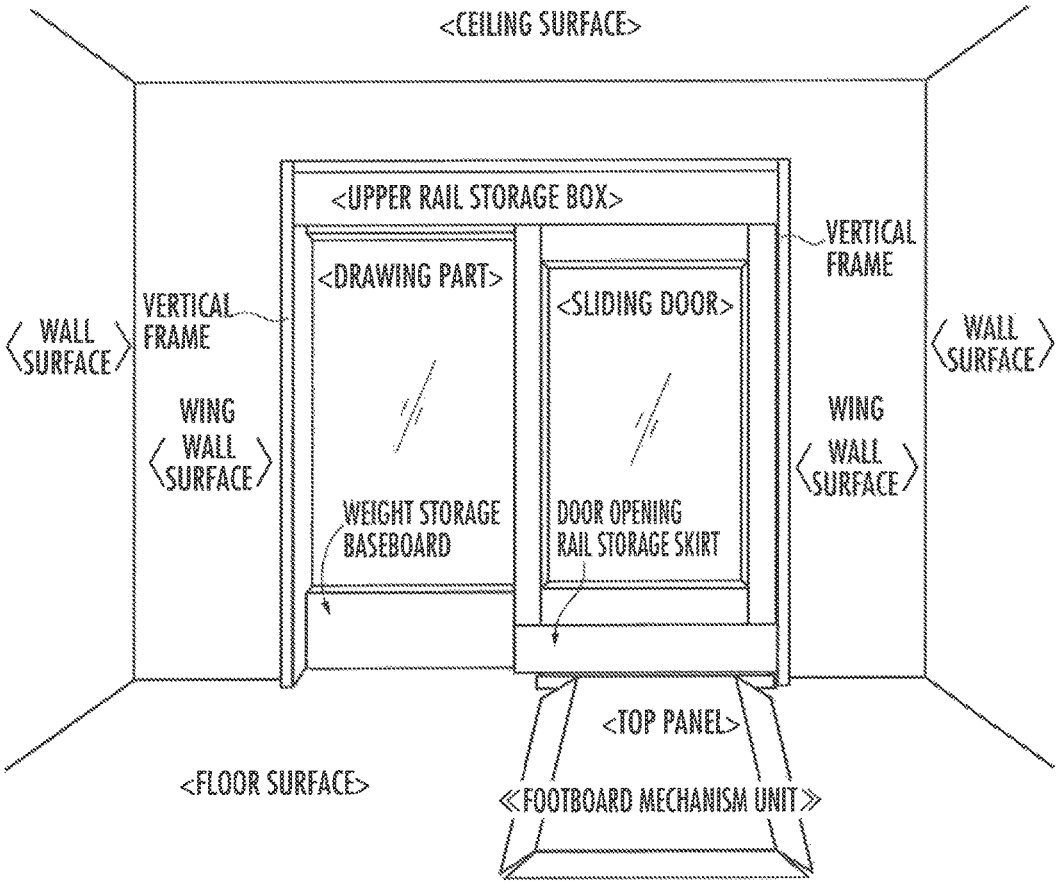
FIG. 8 is an explanatory diagram of Example 2 that illustrates another installation example of the load-type door opening and closing device of the present embodiment.

In construction site, the sizes of the wall opening and the floor dug part were confirmed before the installation construction according to the entire configuration diagram of FIG. 8. The steel lightweight door and the footboard mechanism unit were respectively installed in the wall opening and the floor dug part, levels in the perpendicular direction and the horizontal direction were accurately adjusted with use of a laser, followed by fixing.

A coupling metal fitting that transferred stepping force of the above-described footboard mechanism unit was installed and fixed at a connection part of the footboard mechanism unit and a meeting mullion of the above-described steel lightweight door with accuracy at which errors of a distance from the meeting mullion and the height from the bottom surface of the footboard mechanism unit were ±0.5 mm. A returning hardware was installed and fixed side by side with the coupling metal fitting. The returning hardware was configured to return a top plate of the footboard to an original position with use of a weight included therein by the principle of leverage.

After it was confirmed that the top plate of the footboard was vertically moved by 20 mm to 30 mm, the steel lightweight door was suspended to the supporting rail, and then fixed to a front end of the coupling fitting while the height of a depression pin was adjusted with respect to the door opening rail that was attached to a lower reinforced part of the steel lightweight door. Then, transferring condition of the stepping force, a size of an opening of the door, and the opening and closing speed of the door were adjusted, and the exerted desired property was confirmed. The installation was thus completed. The door and the footboard mechanism unit operated with favorable response without jumping of the door caused by the impact force by a plurality of concurrent users, and no failure was observed.

As with Examples mentioned above, since the present invention is configured such that the stepping force acts on the door opening rail in the vertical downward direction, it is possible to rapidly response to the stepping operation of the footboard to quickly move the sliding door in the opening direction. Also, the sliding door is moved in the closing direction with use of the winding device, and the moving biasing force is applied to the sliding door by a depressing device in an accelerated manner. Thus, rapid opening and closing operation is possible. Further, it is easy to secure large front width.

The coupling fitting with a depressing rod that has an end coupled with the footboard mechanism unit and the other end attached with a runner roller serving as the sliding member may be easily changed in setting of biasing force, which allows for automatic opening and closing of the door even with application of light body weight of a child. In addition, this moves the door in the closing direction manually to lock without effort. The sliding door opening and closing device having such remarkable effects is of a type that opens the door with use of a weight applied to the footboard when a person steps. Thus, the device can be easily installed at a place where securement of electricity for an electric motor is difficult, for example, outdoor simple buildings such as a greenhouse. The automatic door opening and closing device for a heavy door may be operated by a user with light body weight, because of high energy efficiency.

Also, in a steel lightweight door, the size of the skirt part is freely determined. Thus, it is possible to fabricate the steel lightweight door with appropriately set inclined angle and rail width of the door opening rail. Further, a diameter of a runner roller may be set within a range from 50 mm to 60 mm to easily change setting of the biasing force. This makes it possible to improve response, and to improve reliability with less failure, even in a heavy door.

REFERENCE SIGNS LIST

1 door
2 sliding support rail
3 door opening rail
4, 4' sliding member
5 footboard
6 coupling member
11 suspension hook
12 roller
15 constant force spring (winding device
40 returning sliding member
50 footboard-side roller
60 coupling rod
61 first coupling body
62 second coupling body
63 grounding roller
70 gear section
70*a* first gear
70*b* second gear
71,81 first arm
72, 82 second arm
41, 71*c*, 81*c* weight
83 cam mechanism
83*a*, 86 first cam
83*b*, 87 second cam.

The invention claimed is:

1. A door opening and closing device provided with an opening and closing mechanism that uses a body weight of a person to open and close a door, the device comprising:

a sliding support rail slidably supporting the door to open and close the door;

a door opening rail provided in the door and inclined upward in an opening direction of the door; and a footboard that is coupled with a sliding member through a coupling member and moves the door in the opening direction with use of stepping force, the sliding member being configured to slide on the door opening rail, wherein the sliding member is located at an upper end side of the door opening rail in a state in which the door is closed, and stepping force applied to the footboard during opening operation depresses the sliding member against the door opening rail to displace the door in the opening direction.

2. The door opening and closing device according to claim 1, wherein the coupling member includes a first coupling body and a second coupling body, the first coupling body being coupled with the footboard and operating in a vertical direction, the second coupling body having one end coupled with the sliding member and an other end in contact with a ground, and being rotatably fitted to the first coupling body between the one end and the other end.

3. The load type door opening and closing device according to claim 1, wherein the door opening rail has an upward inclination angle in the opening direction of the door that is larger at the upper end side of the door opening rail than at a lower end side of the door opening rail.

4. The load type door opening and closing device according to claim 1, further comprising a winding device that biases the door in a closing direction by winding force of a wire coupled with the door.

5. The door opening and closing device according to claim 1, wherein the coupling member includes a first arm having an end coupled with the footboard, a second arm having an end coupled with the sliding member, and a gear part journaling the first arm and the second arm independently and operating the first arm and the second arm in opposite directions from each other.

6. The door opening and closing device according to claim 1, wherein the coupling member includes a first arm having an end coupled with the footboard, a second arm having an end coupled with the sliding member, and a cam mechanism being provided between the first arm and the second arm that are journaled to a common rotational shaft and operating the first arm and the second arm in opposite directions from each other.

7. The door opening and closing device according to claim 1, wherein the coupling member includes a coupling rod that extends in a perpendicular direction from the footboard and has an end coupled with the footboard and an other end provided with the sliding member.

* * * * *